United States Patent [19]

Kesling

[11] 4,114,614

[45] Sep. 19, 1978

[54] ATHLETIC MOUTHGUARD

[76] Inventor: Peter C. Kesling, Green Acres, LaPorte, Ind. 46350

[21] Appl. No.: 743,303

[22] Filed: Nov. 19, 1976

[51] Int. Cl.[2] ..... A61F 5/56

[52] U.S. Cl. ..... 128/136

[58] Field of Search ..... 128/136, 147, 208

[56] References Cited

U.S. PATENT DOCUMENTS

| | | | |
|---|---|---|---|
| 2,590,118 | 3/1952 | Oddo, Jr. | 128/136 |
| 2,857,909 | 10/1958 | Johnson | 128/136 |
| 3,385,291 | 5/1968 | Martin | 128/136 X |
| 3,485,242 | 12/1969 | Greenberg | 128/136 |
| 3,536,069 | 10/1970 | Gores | 128/136 |

*Primary Examiner*—John D. Yasko
*Attorney, Agent, or Firm*—Lloyd L. Zickert

[57] ABSTRACT

Athletic mouthguard appliance for protecting the mouth of a wearer including a pair of allochiral arch-shaped members hingedly connected together and of a resilient material, wherein the hinge is constructed to provide a springiness against the folding of the arch-shaped members together to retain the members in place on the arches, and wherein the facing portions of the arch-shaped members when the mouthguard is being worn include a plurality of coacting ridges for transmitting forces between the members and preventing relative sliding movement therebetween.

2 Claims, 9 Drawing Figures

FIG. 1
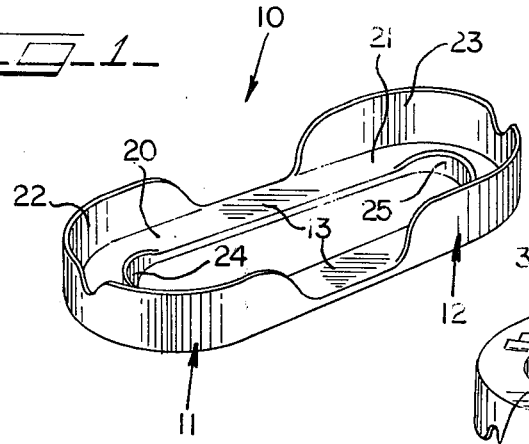
FIG. 2
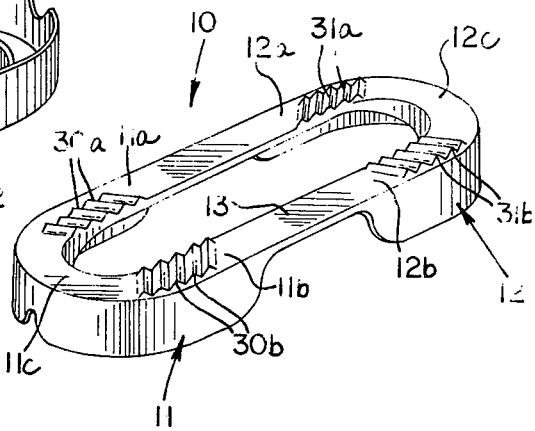
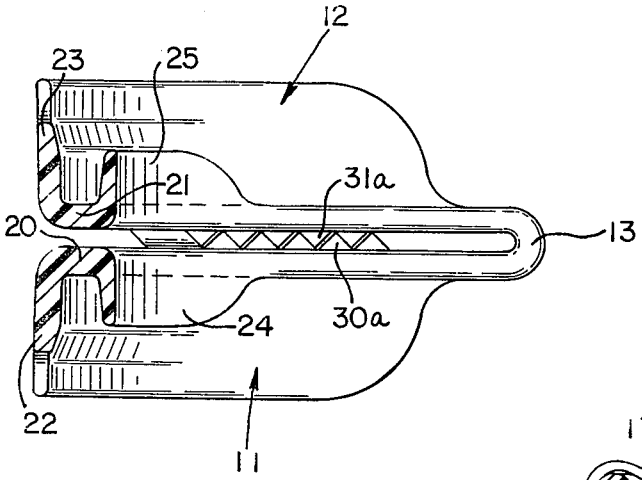
FIG. 3
FIG. 4
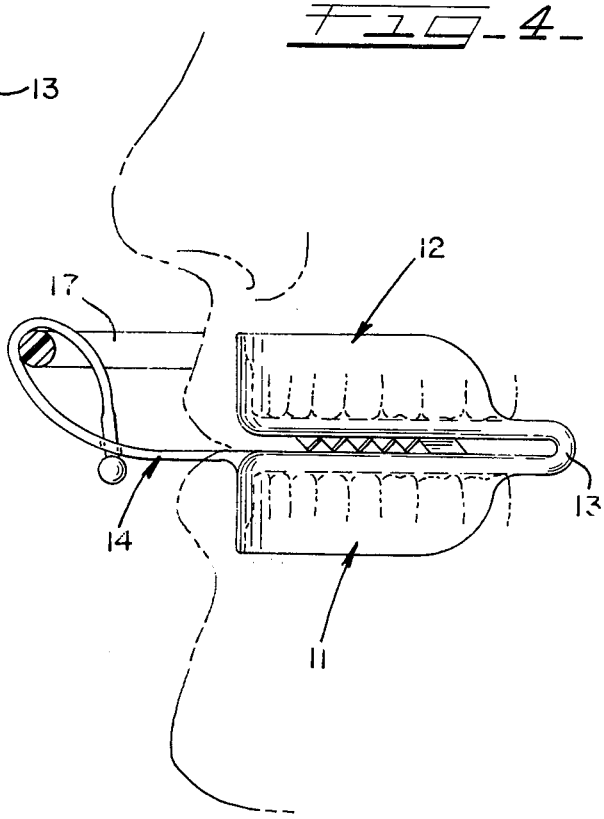

ATHLETIC MOUTHGUARD

This invention relates in general to an athletic mouthguard appliance to be worn by a person for the protection of his mouth, and more particularly, to a mouthguard capable of preventing the abrading of soft tissues of the lips and cheeks against the teeth or any appliances mounted on the teeth, and to prevent the teeth of the upper and lower jaws from coming in contact with one another, and still more particularly, to an improved athletic mouthguard.

The present invention is an improvement over the mouthguard shown in Johnson U.S. Pat. No. 2,857,909, and a mouthguard heretofore known and sold by Isaac Masel Co., Inc. under the trademark DOUBLE-GUARD.

The Johnson patent and the DOUBLEGUARD mouthguards include hingedly connected U-shaped portions, one for each of the arches of a person wearing same, which generally stay in place on the arches during opening of the mouth for the purposes of breathing or talking. Further, these mouthguards in effect form a sheath around the labiobuccal surface of the teeth to isolate the teeth and any appliances worn on the teeth such as orthodontic appliances utilized during the orthodontic treatment of a patient from the soft tissues of the mouth. Heretofore, the facing sides of the arch-shaped members have been smooth wherein the surfaces when wet allow easy slidable movement between the arch-shaped members. The Johnson patent does show raised portions on the facing surfaces for the purpose of preventing a suctional sealing of the parts together which may have a tendency to dislodge a mouthpiece from the proper position in the mouth, but these raised portions are not intended to restrain or are not capable of restraining lateral movements between the arch-shaped members.

The present invention is an improvement over the mouthguard shown in the Johnson patent and the DOUBLEGUARD in that ridges are formed on the facing surfaces of the arch-shaped members for the purpose of interlocking the members when they are in engagement and causing lateral forces applied to one of the members to be transmitted to the other member and to prevent slidable movement between the members, thereby giving greater support to the lower jaw.

The present invention further includes the feature of storing the mouthguard of the invention in a container in such a fashion that it will enhance the life of the mouthguard and will maintain a springy action in the hinge to obtain better overall functioning of the mouthguard when used by a person. In this respect, the arch-shaped members are folded onto themselves in a reverse fashion from the manner in which they are folded in the mouth of a person and containerized wherein the springiness of the hinge is returned for future use of the mouthguard.

It is therefore an object of the present invention to provide an improved athletic mouthguard together with a method of containerizing the mouthguard to enhance its life.

A further object of the present invention is in the provision of a mouthguard molded of resilient material such as a soft thermoplastic and which includes a pair of arch-shaped members hingedly connected so that the hinge is positioned at the rear of the mouth when the arch-shaped members are in position on the teeth of a wearer and wherein means is provided on the facing surfaces of the arch-shaped members when they are in the mouth of a wearer to interlock the members with each other when they are in engagement and to cause transmission of lateral forces directly between the arch-shaped members and prevent relative sliding action therebetween.

A further object of the invention is in the provision of a method of storing or containerizing a one-piece athletic mouthguard of resilient material which includes a pair of arch-shaped members hingedly connected together and wherein the method consists of storing the mouthguard in reverse folded position so as to reinduce a springy action in the hinge such as to enhance the maintenance of the arch-shaped members in place on the arches of a person when it is being worn.

Other objects, features and advantages of the invention will be apparent from the following detailed disclosure, taken in conjunction with the accompanying sheets of drawings, wherein like reference numerals refer to like parts, in which:

FIG. 1 is a perspective view of the athletic mouthguard appliance of the invention;

FIG. 2 is a perspective view like FIG. 1 but showing the opposite side;

FIG. 3 is an enlarged axial sectional view taken through the mouthguard in folded condition and illustrating the interlocking of the upper and lower sections;

FIG. 4 is a side elevational view of the mouthguard appliance with a helmet strap positioned in the mouth of a person to illustrate how the appliance is worn when the mouth is closed, wherein the person is shown in phantom;

Figure 5:
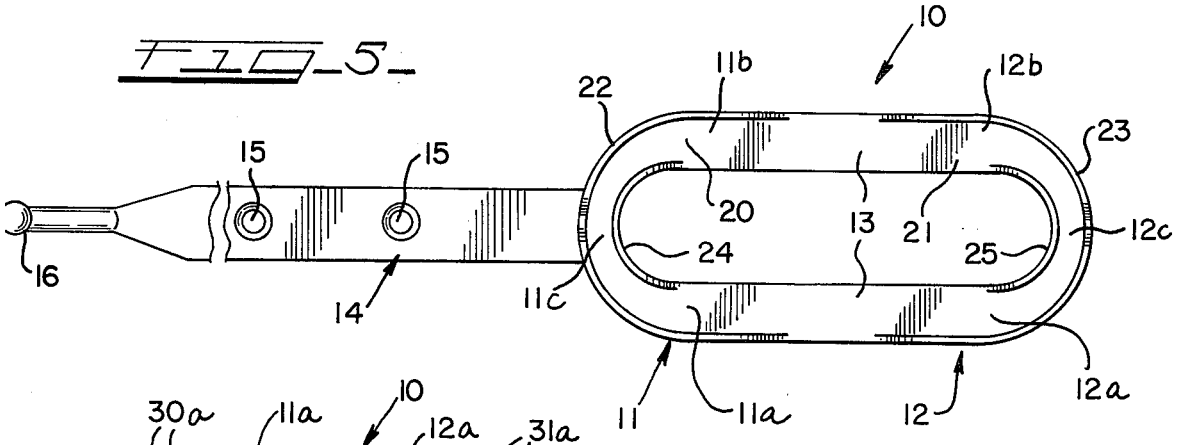
FIG. 5 is a top plan view of the mouthguard with the optional helmet strap.

Referring now to the drawings, and particularly to FIGS. 1 and 2, the mouthguard of the invention is generally designated by the numeral 10 and includes a pair of allochiral arch-shaped or U-shaped members or sections 11 and 12 hingedly connected together by hinge connections or hinge portions 13. An optional helmet strap 14 is shown in FIGS. 4, 5, 6 and 8 which extends from the member 11 and includes a plurality of holes 15 through which a ball-shaped end 16 may be forced to define a locking loop for the purpose of locking or connecting the mouthguard to a helmet face mask 17, as shown in FIG. 4. It will be appreciated that the optional helmet strap may be used to otherwise connect or lock the mouthguard to any other device that may be worn by the person using the mouthguard.

The mouthguard is constructed of a suitable resilient material such as a thermoplastic which will give it the desired qualities for use in the mouth of a person. It will be appreciated the material must be of a type approved for use in the mouth of a person and it may be of any desired color. Further, it may be of a suitable natural or synthetic rubber or a suitable plastic where it is relatively soft and pliable so that it may be easily manipulated within the mouth of a person and capable of protecting the mouth and teeth in a desired manner. While the mouthguard is worn on the teeth of a person, it will be appreciated that the mouthguard not only protects the teeth but also protects the surrounding soft tissues of the mouth. The material must also be such as to define a springiness in the hinge portions.

Each of the arch-shaped or U-shaped members 11 and 12 includes respectively flat U-shaped or arch-shaped base portions 20 and 21, upstanding wall portions 22 and 23 at the labiobuccal edges of the base portions, and upstanding wall portions 24 and 25 at the lingual or inner edges of the base portions. The hinge connections or portions 13 are essentially a continuation of the base portions 20 and 21. Further, it may be appreciated that the entire mouthguard is one piece or unitary and is molded of a resilient material. The thickness of the base portions and upstanding wall portions may be gauged to provide adequate strength for the mouthguard and to provide a good fit within the mouth. As noted particularly in FIG. 5, the spacing between the wall portions 22 and 24 and 23 and 25 at the area where the anterior teeth will be received is narrower than at the area where the posterior teeth are received. It can be further appreciated that the occlusal surface of the teeth will engage the sides or faces of the base portions from which extend the upstanding wall portions. The upstanding wall portions define a pocket or trough into which the anterior teeth are received for positioning the mouthguard relative to the teeth. The height of the labiobuccal wall portions 22 and 23 is such that they will overlie the labiobuccal surfaces of the teeth and any orthodontic appliances that may be secured to the teeth, thereby protecting the mouth tissues from injury should they be forced toward the teeth. The height of the lingual wall portions 24 and 25 is such as to provide guidance for the proper placement of the teeth against the base portions of the arch-shaped members when the mouthguard is being worn by a person.

The optional helmet strap 14 is connected to one of the U-shaped members at a point where it will essentially be aligned with the junction of the lips of a person so that it can be comfortably worn when extending therebetween with minimum disturbance of the lips, as seen in FIG. 4. Arch-shaped member 12 is illustrated in position on the maxillary and arch-shaped member 11 is shown in position on the mandibular. However, the members 11 and 12 are identical and therefore can be interchanged where the member 11 could be fitted on the maxillary arch and the member 12 could be fitted on the mandibular arch.

In order to prevent or at least inhibit relative lateral movement between the jaws or arches of a person during wearing of the mouthguard, coacting ridges are provided on the engaging surfaces of the arch-shaped members. The base portions of the arch-shaped members include legs or side sections 11*a*, 11*b*, 12*a* and 12*b*, respectively, interconnected by front or bight sections or connecting arms 11*c* and 12*c*. The opposing legs of each arch-shaped member, together with the hinge connections therebetween when the mouthguard is in its relaxed state, as shown in FIGS. 1 and 2, are essentially in the form of straight bars.

Figure 7:
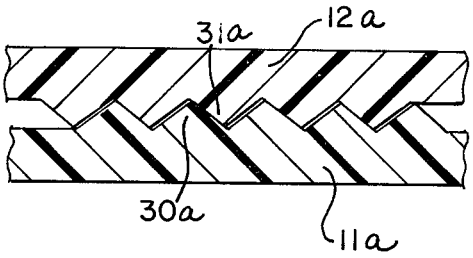
FIG. 7 is a greatly enlarged detail cross-sectional view taken through the mouthguard in the area where the ridges are provided and showing them in interlocking relationship.

Relative lateral movement between the arch-shaped members 11 and 12 when the mouthguard is being worn in the mouth of a person is prevented by ridges 30*a* and 30*b* and ridges 31*a* and 31*b* formed on the facing surfaces of the arch-shaped members when they are in opposed relation within the mouth of a person. These ridges interlock as shown in FIGS. 3, 4 and 7. The ridges are provided in groups formed on the legs of the arch-shaped members. While five ridges are shown in each group, it can be appreciated that a greater or lesser number may be provided if so desired.

Figure 6:
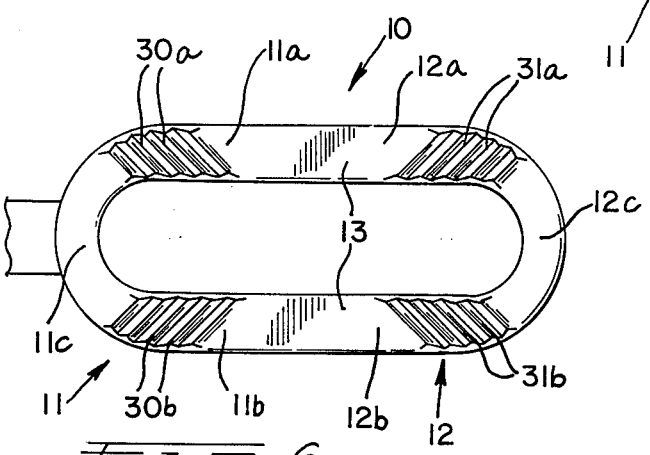
FIG. 6 is a bottom plan view of the mouthguard with a portion of the helmet strap broken away.

Further, the ridges are angularly related to the legs of the U-shaped members and preferably extend at a 45° angle to the legs, as shown more clearly in FIG. 6. The ridges on each U-shaped member are oriented so that the ridges on one leg extend in one direction, while the ridges on the other leg extend in an opposite direction. More specifically, as seen in FIG. 6, the ridges 30*a* and 30*b* are oriented such that lines extending through the ridges will intersect at points along a center line extending longitudinally through the mouthguard and projecting toward the center of the mouthguard or away from the bight portions of the arch-shaped members. The orientation of the ridges 31*a* and 31*b* on the arch-shaped member 12 is such that when the two arch-shaped members come together during the folding of the mouthguard in the mouth of a person, the ridges of each U-shaped portion extend parallel to each other so that the ridges may interlock as shown in FIGS. 3, 4 and 7 and effectively oppose forces from any direction along a plane extending at the biting or occlusal surfaces of the teeth. Accordingly, slots or recesses are formed between the ridges so that ridges of the opposing arch-shaped members may be received in those slots or recesses. By virtue of the orientation of the ridges, forces transmitted to one jaw will be transmitted through the mouthguard to the other jaw since the ridges inhibit relative movement between the arch-shaped members. Accordingly, relative slippage or sliding movement between the arch-shaped members is inhibited when the mouthguard is within the mouth of a patient and the mouth is closed so the ridges interlock.

Figure 8:
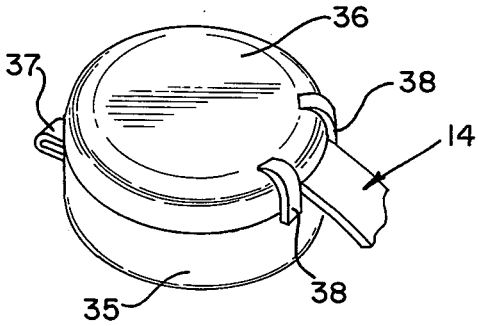
FIG. 8 is a perspective view of a container for the mouthguard and showing the helmet strap protruding from the container.
Figure 9:
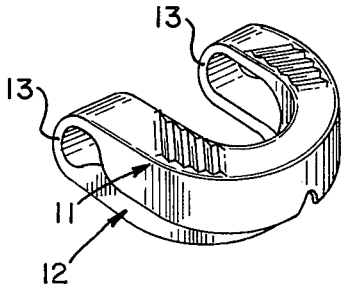
FIG. 9 is a perspective view of the mouthguard without a helmet strap shown in folded position just prior to insertion into the container.

The hinge connections 13 produce a force to cause the mouthguard to open up to the relaxed state, as shown in FIGS. 1, 2, 5 and 6, which assists in maintaining the mouthguard in place on the teeth of a person when the mouth is opened for breathing or talking purposes. Inasmuch as the material employed for the making of the mouthguard may take a set after continued usage, it is stored according to the present invention in a container in a reverse folded manner, as shown in FIG. 9. Looking particularly at FIG. 9, it will be seen that the U-shaped members are reverse folded so that the labiobuccal wall portions come into telescopic relationship with one another, after which the folded mouthguard can be inserted into a container such as shown in FIG. 8.

This container is circular in shape and includes a bottom portion 35 and a cover portion 36 interconnected by a hinge 37 and having latching members 38 opposite the hinge 37 and extending from the cover portion 36 to engage the bottom portion 35. An opening is provided at the front of the container through which the helmet strap 14 may extend. This opening may be eliminated if the mouthguard does not have a helmet strap. By reverse folding of the mouthguard, springiness is reinduced in the hinge connections 13 for enhancing the wearing of the appliance during its next use.

It will be understood that modifications and variations may be effected without departing from the scope of the novel concepts of the present invention, but it is understood that this application is to be limited only by the scope of the appended claims.

The invention is hereby claimed as follows:

1. A one-piece athletic mouthguard of resilient material for protecting the mouth of a wearer comprising, a pair of allochiral arch-shaped members, hinge means interconnecting said members at the distal ends thereof in end-to-end relation, each said arch-shaped member including a base portion having an inside surface adapted to be engaged by the occlusal surfaces of the teeth of a wearer and an outside surface adapted to face and/or engage the outside surface of the other arch-shaped member when the mouthguard is in position in the mouth of a wearer, each base portion including a front section and opposed substantially parallel side sections, means on the outside surfaces of the side sections of said base portions coacting during engagement of said outside surfaces to transmit forces between said members and to interlock said members against relative sliding movement therebetween, said means including a plurality of parallel ridges on the side sections extending about 45° to said side sections, the ridges on one side section of a base portion extending in a direction opposite to the ridges on the other side section thereof, an upstanding portion at the labiobuccal edge of said base portion for overlying the labiobuccal surfaces of the teeth and any appliances mounted thereon, and an upstanding guide flange at the lingual edge of the base portion in the area of the anterior teeth.

2. The one-piece mouthguard as defined in claim 1 and said mouthguard including a helmet strap extending from one of said arch-shaped members.

* * * * *